US008970331B2

(12) United States Patent
Chang et al.

(10) Patent No.: US 8,970,331 B2
(45) Date of Patent: Mar. 3, 2015

(54) KEYSWITCH ASSEMBLY AND KEYBOARD

(75) Inventors: Chao Lung Chang, Taoyuan (TW); JiHuang Chen, Taoyuan (TW); Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 197 days.

(21) Appl. No.: 13/489,174

(22) Filed: Jun. 5, 2012

(65) Prior Publication Data

US 2012/0313738 A1 Dec. 13, 2012

(30) Foreign Application Priority Data

Jun. 9, 2011 (TW) ..... 100210415 U
Aug. 4, 2011 (TW) ..... 100214365 U

(51) Int. Cl.
*H01H 9/00* (2006.01)
*H01H 13/702* (2006.01)
*H01H 3/12* (2006.01)

(52) U.S. Cl.
CPC ..... *H01H 13/702* (2013.01); *H01H 3/125* (2013.01); *H01H 2221/04* (2013.01); *H01H 2227/036* (2013.01)
USPC ..... 335/205; 200/341

(58) Field of Classification Search
CPC ..... H01H 3/125; H01H 3/12–3/142
USPC ..... 335/205–207; 200/510, 341
See application file for complete search history.

(56) References Cited

U.S. PATENT DOCUMENTS

| | | | | |
|---|---|---|---|---|
| 3,906,417 | A * | 9/1975 | Serras-Paulet | 335/205 |
| 4,453,148 | A | 6/1984 | Norakidze et al. | |
| 6,677,843 | B1 * | 1/2004 | Monroe et al. | 335/205 |
| 2002/0096424 | A1 * | 7/2002 | Chun | 200/344 |
| 2003/0136658 | A1 * | 7/2003 | Hsu et al. | 200/517 |
| 2006/0257190 | A1 * | 11/2006 | Chiang | 400/474 |
| 2007/0119696 | A1 * | 5/2007 | Lu | 200/50.36 |
| 2010/0147662 | A1 * | 6/2010 | Yeh et al. | 200/314 |

* cited by examiner

*Primary Examiner* — Alexander Talpalatski
(74) *Attorney, Agent, or Firm* — Christensen Fonder P.A.

(57) ABSTRACT

A keyswitch assembly includes a movable keycap having a space provided in a bottom of the keycap; a metal support plate having an opening, the metal including a cantilever bridge; a switch located under the opening of the metal support plate; a magnet disposed within the space of the keycap; wherein as the keycap is undepressed, the keycap is in an initial state and the keyswitch assembly is OFF, and the magnet draws in the cantilever bridge, and as the keycap is depressed downward, the magnet is forced to depart from the cantilever bridge and actuates the switch making the keyswitch assembly to turn ON. As the forced is released, the magnetic force between the cantilever bridge and the magnet forces the keycap to return its initial state.

15 Claims, 8 Drawing Sheets

KEYSWITCH ASSEMBLY AND KEYBOARD

CROSS-REFERENCE TO RELATED APPLICATION

This utility application claims priority to Taiwan application serial number 100210415, filed on Jun. 9, 2011, and 100214365, filed on Aug. 4, 2011, that are incorporated herein by reference.

BACKGROUND OF THE DISCLOSURE

1. Field of the Disclosure

The invention relates to a keyswitch assembly and a keyboard, and more particularly, to a keyswitch assembly utilizing the magnetic attraction force as restoration driving force for the keycap.

2. Brief Description of the Related Art

Other than the mobile devices with touch panel input apparatus, to many electronic devices the keyboard still is an indispensable apparatus. But due to the need for ultra thin notebook computers, keyboard on the ultra thin notebook computers needs to be as thin as possible.

The conventional keyswitch assembly typically has an elastic element, such as the rubber dome, which provides a driving force resuming the keycap to its initial state as an applied force on keyswitch is released. However, the conventional elastic element has a minimum height for operation which requires a height for the keyswitch assembly to accommodate the elastic element. In other words, the size of conventional keyswitch assembly can not be reduced further due to the existence of the elastic element.

The keyswitch having magnetic elements has been used in the production of keyswitch assembly, and the related technologies can be found in U.S. Pat. No. 4,453,148.

One of the objectives of the invention is the reduction of overall height of keyswitch and the keyboard.

The technical issue to be tackled is achieved by providing a keyswitch assembly employing magnetic attraction force as driving force for the keycap to restore to its initial state by the invention.

SUMMARY OF THE DISCLOSURE

According to a preferred embodiment, the keyswitch assembly includes a movable keycap, a metal support plate, a switch and a magnet. The movable keycap has a bottom providing a space. The metal support plate has an opening and includes a cantilever bridge. The switch is located beneath the opening of support plate. The magnet is disposed within the space of keycap. As the keycap is undepressed, the keycap is in an initial state and the keyswitch assembly is in OFF state, and the magnet attracts to contact the cantilever bridge. As the keycap moves downward by a force, the magnet actuates the switch making the keyswitch assembly in ON state. As the force is released the keycap resumes to the initial state, due to the magnetic attraction force between the magnet and the cantilever bridge.

In one embodiment, the keycap includes a pivotal for connecting to the metal support plate pivotally.

According to a second preferred embodiment, the keyswitch assembly includes a movable keycap, a metal support plate, a switch and a magnet. The movable keycap has a space. The metal support plate has an opening and includes a bridge pillar and a bridge floor. The switch is located beneath the opening of the support plate. The magnet is disposed within the space of keycap. As the keycap is undepressed, the keycap is in an initial state and the keyswitch assembly is in OFF state, and the magnet attracts to contact the bridge floor. As the keycap moves downward by a force, the magnet actuates the membrane switch making the keyswitch assembly in ON state. As the force is released, the keycap resumes to the initial state due to the magnetic attraction force between the magnet and the bridge floor. The switch may be a membrane switch.

According to a third preferred embodiment, the keyswitch assembly includes a movable keycap, a metal support plate, a switch and a magnet. The movable keycap has a bottom extending to form a hook leg and the hook leg has a leg plane. The metal support plate includes a cantilever bridge. The switch is located beneath the keycap. The magnet is disposed on the leg plane. As the keycap is undepressed, the keycap is in an initial state and the keyswitch assembly is in OFF state, and the magnet attracts to contact the cantilever bridge. As the keycap moves downward by a force, the magnet escapes from the cantilever bridge. As the force is released, the keycap resumes to the initial state due to the magnetic attraction force between the magnet and the cantilever bridge. As the keycap moves downward by a force, the hook leg actuates the switch.

In one embodiment, keyswitch assembly further comprises a scissors-type supporting element respectively connected to the keycap and the metal support plate, wherein the scissors-type supporting element further includes an actuator, and as the keycap moves downward by a force, the actuator actuates the switch.

In one embodiment, an actuator is provided at the bottom of keycap, and as the keycap moves downward by a force, the actuator actuates the switch.

According to the fourth preferred embodiment, the keyswitch assembly includes a movable keycap, a metal support plate, and a switch. The movable keycap has a bottom extending to form a hook leg, the hook leg has a leg plane and the leg plane is embedded with a metal plate. The metal support plate includes a cantilever bridge having a bottom providing a magnet which corresponds to the metal plate. The switch is located beneath the keycap. As the keycap is undepressed, the keycap is in an initial state and the keyswitch assembly is in OFF state, and the magnet attracts to contact the metal plate. As the keycap moves downward by a force, the magnet escapes from the metal plate. As the force is released, the keycap resumes to the initial state due to magnetic attraction force between the magnet and the metal plate. As the keycap moves downward by a force, the hook leg actuates the switch.

The accompanying drawings, incorporated as a part of this specification, are used for further understandings of the preferred embodiments of the invention and can not be used to limit the protected scope of the invention that are described in the attached claims.

Figure 1A:
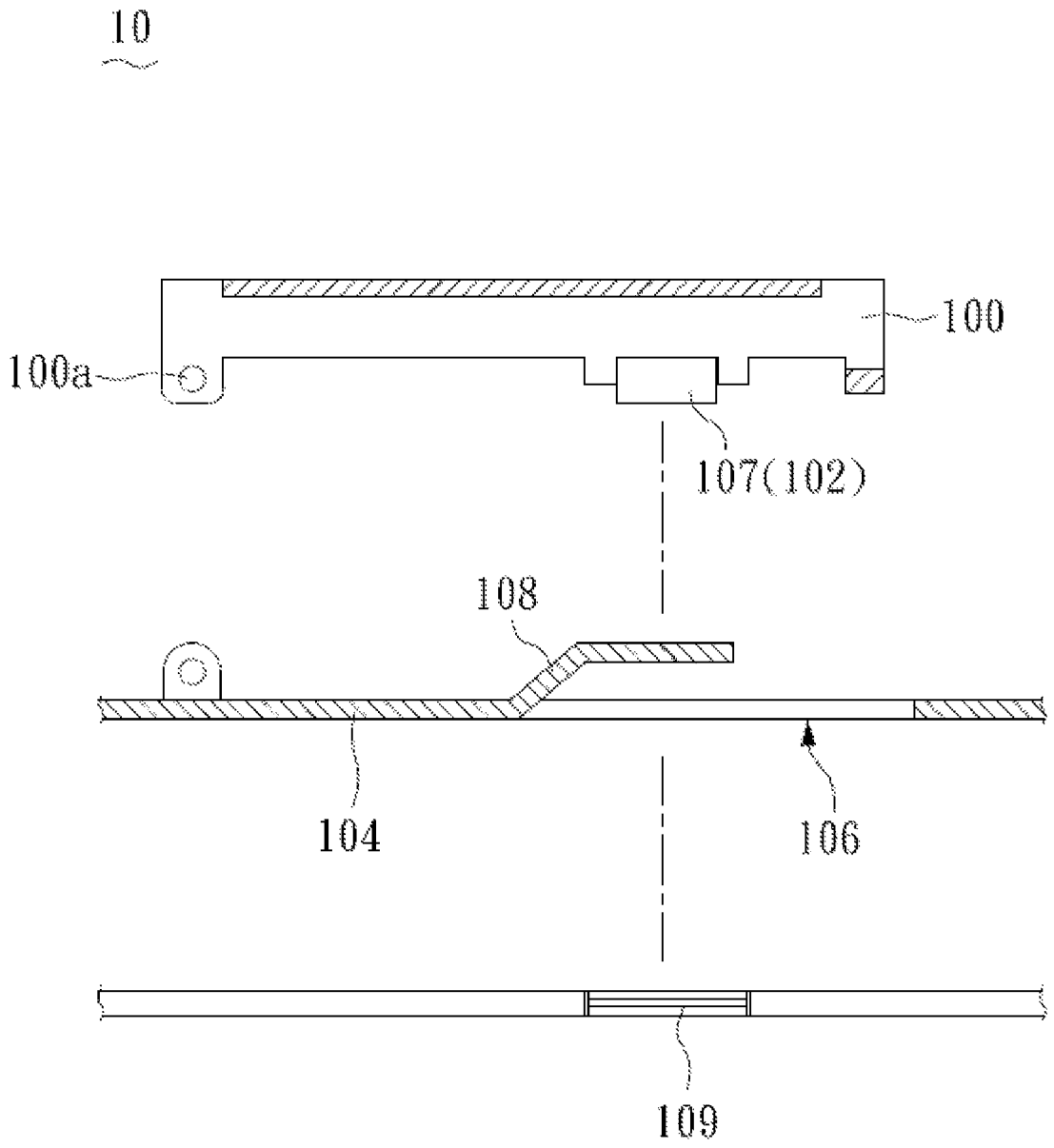
FIG. 1A illustrate a keyswitch assembly in accordance with an embodiment of the present invention in explosive form.

While preferred embodiments are depicted in the drawings, those embodiments are illustrative and are not exhaustive, and many other equivalent embodiments may be envisioned and practiced based on the present disclosure by persons skilled in the arts.

DETAILED DESCRIPTION OF THE INVENTION

The present invention now will be described more fully herein with reference to the accompanied figures, in which embodiments of the invention are shown. This invention may, however, be embodied in many alternate forms and should not be construed as limited to the embodiments set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like numbers refer to like elements throughout the description of the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising" used in this specification do not preclude the presence or addition of one or more other selectivity features, steps, operations, elements, components, and/or groups thereof. And the term "and/or" includes any and all combinations of one or more of the associated listed items.

Unless otherwise defined, all terms used herein have the same meaning as commonly understood by one of ordinary skill in the art to which this invention belongs. It will be further understood that terms defined in commonly used dictionaries will not be interpreted in an idealized or overly formal sense unless expressly so defined herein.

Referring to FIG. 1A, a preferred embodiment of the keyswitch assembly 10 shown includes a movable keycap 100, a metal support plate 104, a switch 109, and a magnet 107. The bottom of movable keycap 100 has a space 102. The metal support plate 104 has an opening 106 and includes a cantilever bridge 108. The switch 109 is located beneath the opening 106 of support plate 104. The magnet 107 is disposed within the space 102 of keycap 100. As the keycap 100 is undepressed, the keycap 100 is in an initial state shown in FIG. 1B, and the keyswitch assembly 10 is in OFF state, the magnet 107 attracts to contact the cantilever bridge 108. As the keycap 100 moves downward by a force, the magnet 107 actuates the switch 109 making the keyswitch assembly 10 in ON state. As the applied force is released, because of the magnetic attraction force between the magnet 107 and the cantilever bridge 108, the keycap 100 resumes to the initial state. The keycap 100 has a pivotal 100*a* for connecting pivotally to the metal support plate 104. The switch 109 may be a printed circuit board membrane switch of single layer, dual layers or three layers.

Figure 1B:
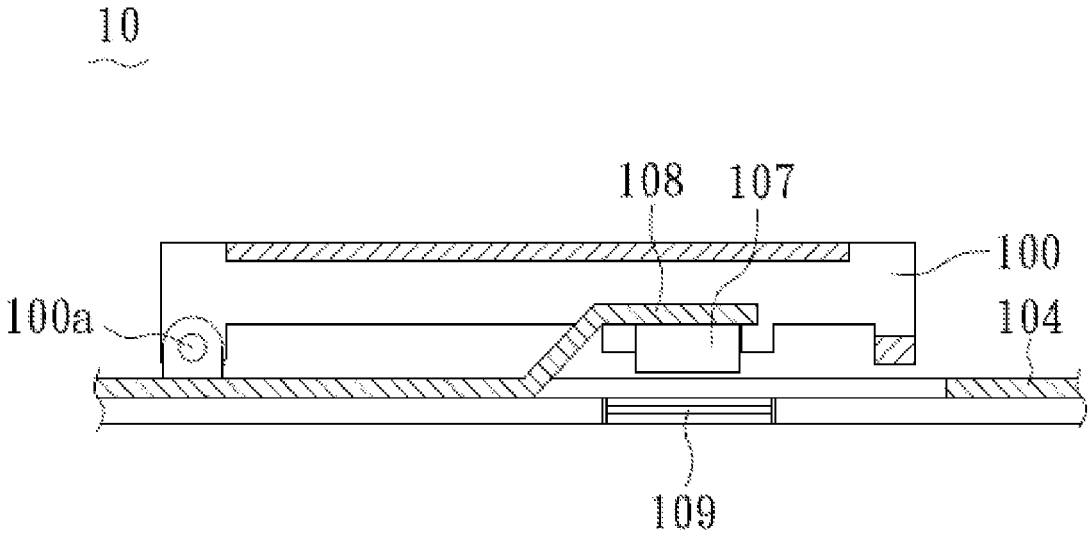
FIG. 1B illustrates the keyswitch assembly of FIG. 1A in assembly form (while switch is OFF).
Figure 1C:
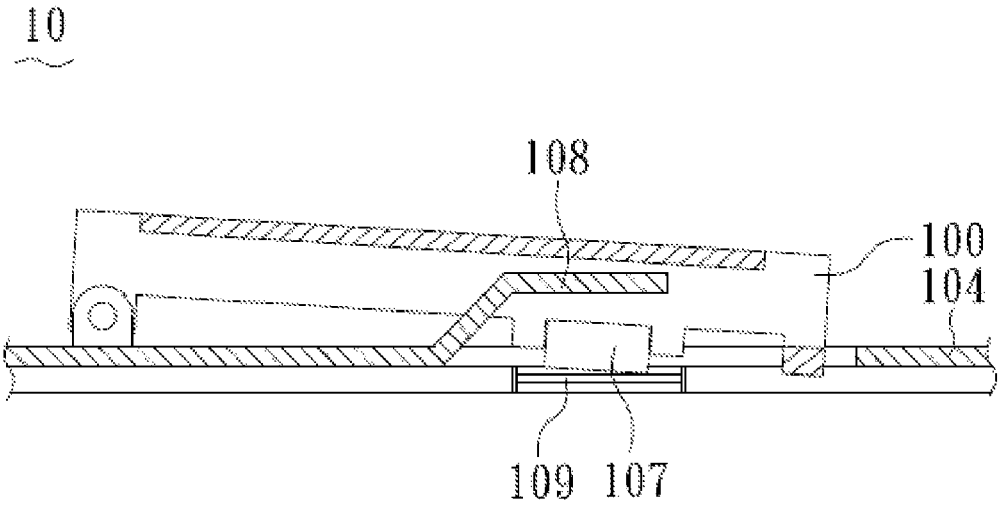
FIG. 1C illustrates the keyswitch assembly of FIG. 1A in assembly form (while switch is ON).

FIG. 1B shows the keyswitch assembly of FIG. 1A in assembly form (while switch 109 is OFF). Since the attraction force between the magnet 107 and the cantilever bridge 108, the keycap 100 naturally moves upwardly to an upper dead point at which the switch 109 is OFF. FIG. 1C shows the keyswitch assembly of FIG. 1A in assembly form (while switch 109 is ON) when an external force is applied on the keycap 100. This external force must to confront the magnetic attraction force between the magnet 107 and the cantilever bridge 108 in order to move the keycap 100 downward to a lower dead point. As the lower dead point is reached, the switch 109 is turned ON by the magnet 107. Afterwards as the applied force disappears, the keyswitch assembly 10 will transit from state of FIG. 1C to that of FIG. 1B.

Figure 2A:
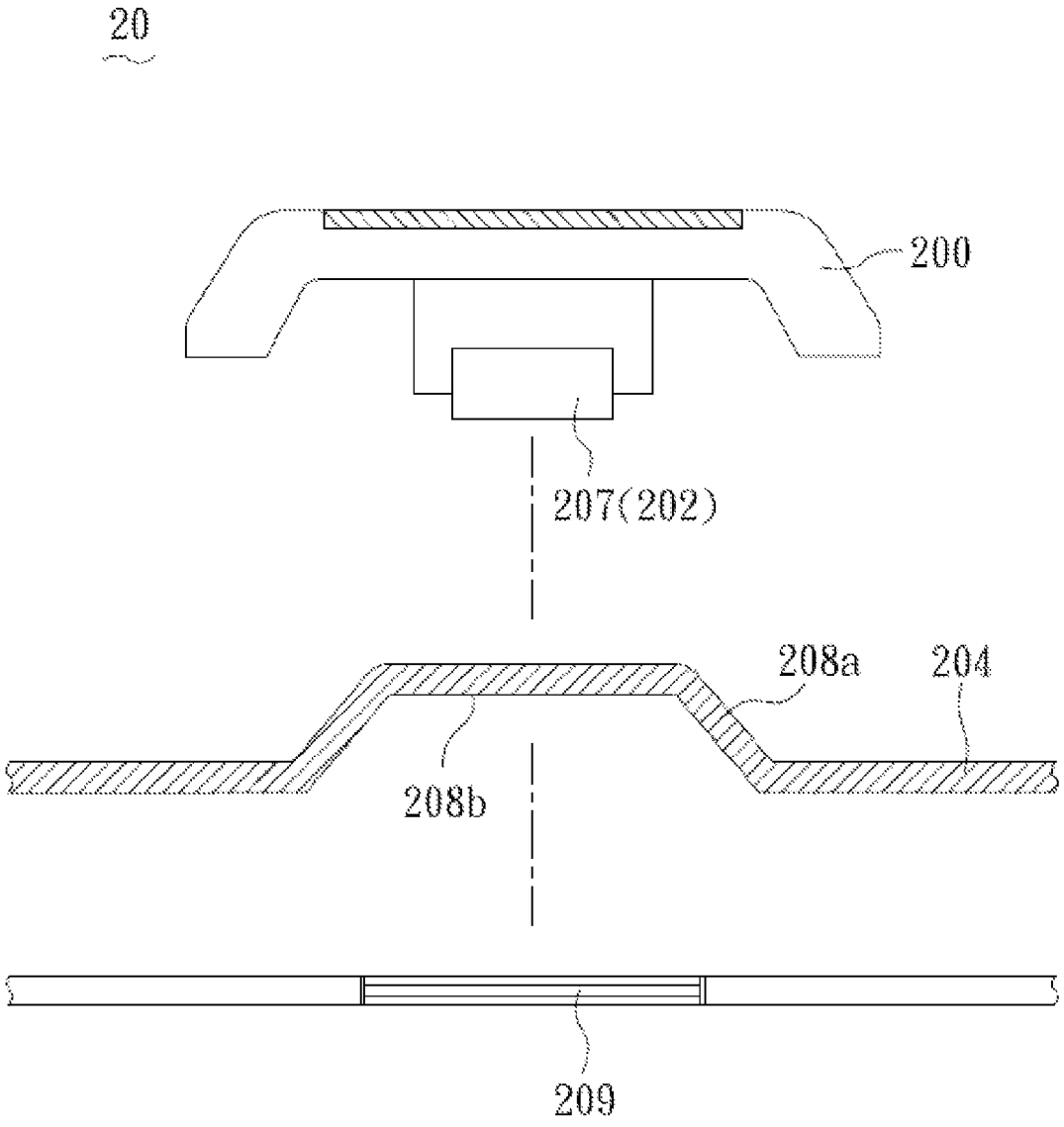
FIG. 2A illustrates a keyswitch assembly in accordance with a second embodiment of the present invention in explosive form.
Figure 2B:
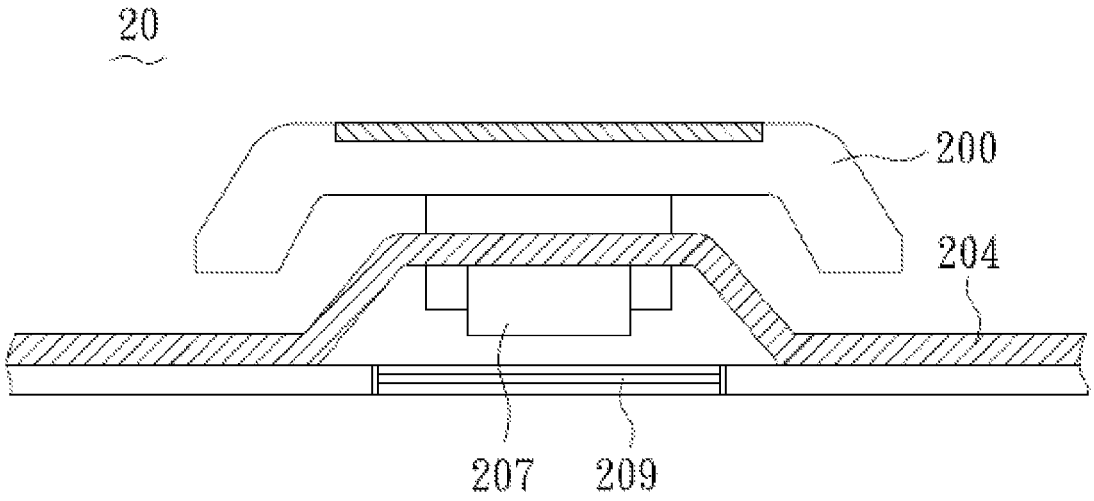
FIG. 2B illustrates the keyswitch assembly of FIG. 2A in assembly form (while switch is OFF).

In another preferred embodiment shown in FIG. 2A, a keyswitch assembly 20 includes a movable keycap 200 having a space 202, a metal support plate 204 having an opening, a switch 209 and a magnet 207. The metal support plate 204 includes a bridge pillar 208*a* and a bridge floor 208*b*. The switch 209 is located beneath the opening of support plate 204. The magnet 207 is disposed within the space 202 of keycap 200. As the keycap 200 is undepressed, the keycap 200 is in an initial state, as shown in FIG. 2B, and the keyswitch assembly 20 is in OFF state, and the magnet 207 attracts to contact the bridge floor 208*b*. As the keycap 200 moves downward due to a force, the magnet 207 actuates the switch 209 making the keyswitch assembly 20 in ON state. As the force is released, the keycap 200 moves upward resuming to the initial state due to the magnetic attraction force between the magnet 207 and the bridge floor 208*b*.

Figure 2C:
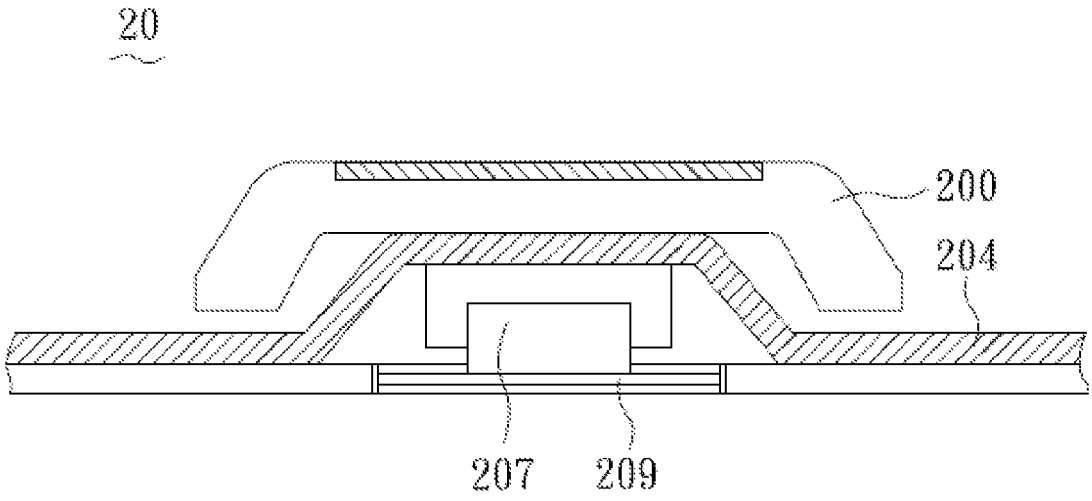
FIG. 2C illustrates the keyswitch assembly of FIG. 2A in assembly form (while switch is ON).

FIG. 2B shows the keyswitch assembly of FIG. 2A in assembly form (while the switch 209 is OFF). Due to the attraction force between the magnet 207 and the bridge floor 208*a*, the keycap 200 naturally moves upward to an upper dead point at which the switch 209 is in OFF state. FIG. 2C shows the keyswitch assembly of FIG. 2A in assembly form (while the switch 209 is ON) in which an external force is applied on the keycap 200. This external force has to resist the magnetic attraction force between the magnet 207 and the bridge floor 208*a* in order to move the keycap 200 downward to a lower dead point. As the lower dead point is reached, the switch 209 is activated to ON state by the magnet 207. Afterwards as the applied force disappears, the state of the keyswitch assembly 20 changes from state of FIG. 2C to that of FIG. 2B.

Furthermore, the distance between two bridge pillars 208*a* may be about identical to the width of the magnet 207 to restrain the lateral displacement of the magnet 207 during its vertical movement. The switch 209 may be a membrane switch.

While employing the above described keyswitch assembly 10, a preferred embodiment of the invention is a keyboard which includes at least a keyswitch assembly 10.

Figure 3A:
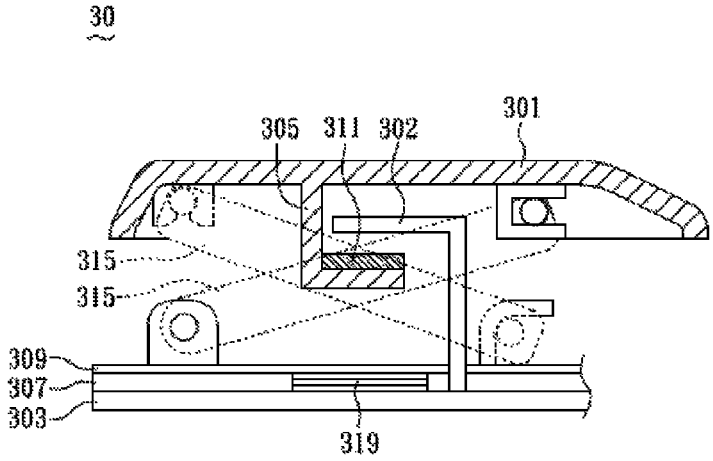
FIG. 3A illustrates a third preferred embodiment.

As shown in FIG. 3A, another preferred embodiment of the keyswitch assembly 30 includes a movable keycap 301, a metal support plate 303, a switch 319 located beneath the keycap 301 and a magnet 311 disposed on a leg plane. The movable keycap 301 has a bottom extending to form a hook leg 305 which has a leg plane. The metal support plate 303 includes a cantilever bridge 302. As the keycap 301 is undepressed, the keycap 301 is in an initial state and the keyswitch assembly 30 is in OFF state, and the magnet 311 attracts to contact the cantilever bridge 302. As the keycap 301 moves downward by a force, the magnet 311 escapes from the cantilever bridge 302. As the force is released, the magnetic attraction force between the magnet 311 and the cantilever bridge 302 forces the keycap 301 to resume to the initial state.

The label 315 indicates a conventional scissors-type supporting element which is respectively connected to the keycap 301 and the metal support plate 303. The element label 309 indicates a conventional membrane disposed on the circuit membrane 307 for protecting the circuit membrane 307. According to a preferred embodiment, the membrane 309 may be a Polyester membrane (Mylar). As the keycap 301 moves downward by a force, the hook leg 305 actuates the switch 319.

Figure 3B:
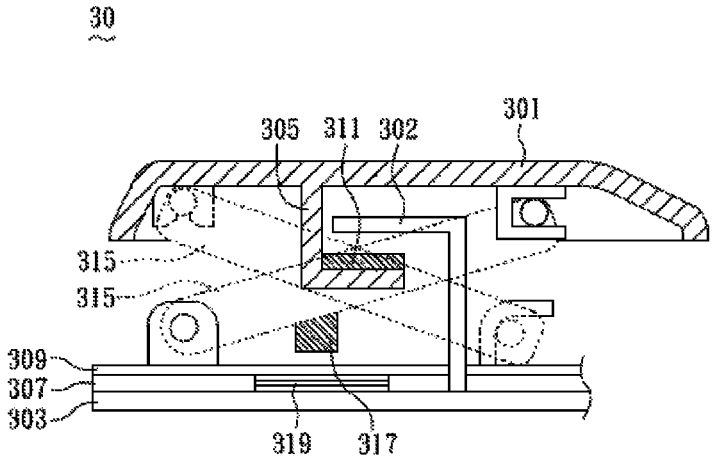
FIG. 3B illustrates a fourth preferred embodiment.

FIG. 3B discloses another preferred embodiment which has some parts identical to those shown in FIG. 3A. The difference between this embodiment and that of FIG. 3A resides on that the scissors-type supporting element 315 further has an actuator 317 which actuates the switch 319 as the keycap 301 moves downward by a force.

Figure 3C:
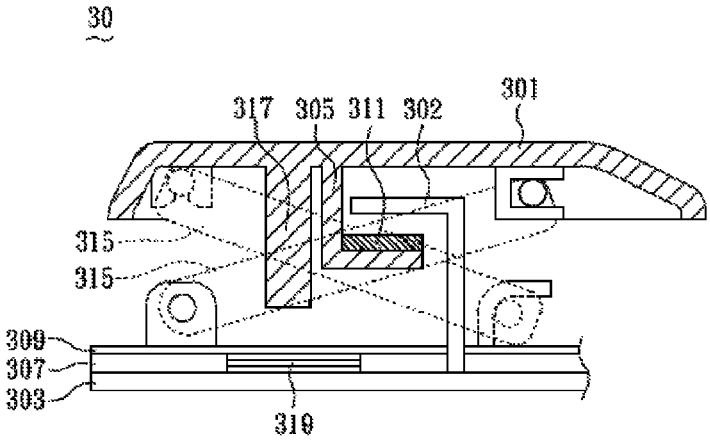
FIG. 3C illustrates a fifth preferred embodiment.

FIG. 3C discloses still another preferred embodiment which has some parts identical to those shown in FIG. 3A. The difference between this embodiment and that of FIG. 3A resides on that the downside of keycap 301 has an actuator 317 to actuate the switch 319 as the keycap 301 moves downward by a force.

Figure 4A:
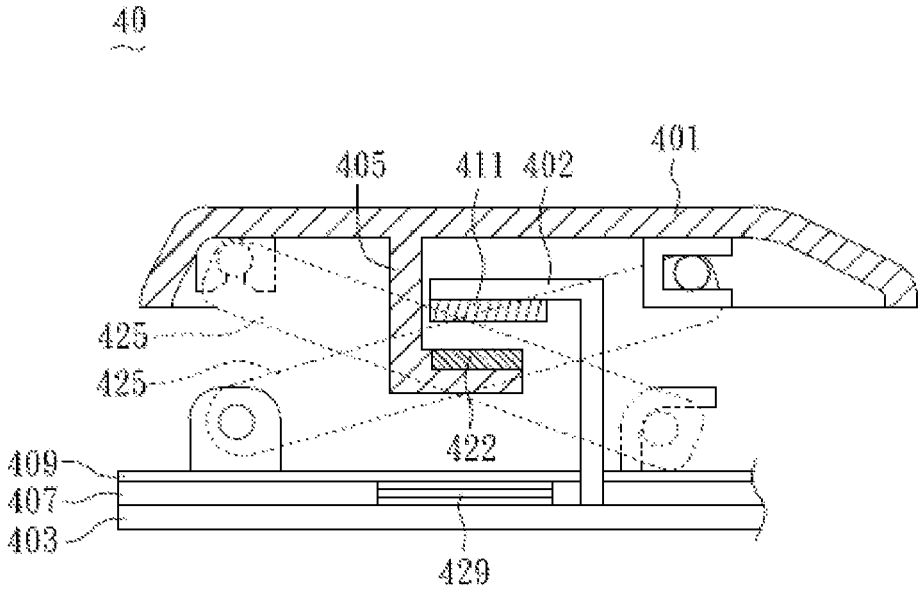
FIG. 4A illustrates another (sixth) preferred embodiment.

As indicated in FIG. 4A, in accordance with another preferred embodiment, the keyswitch assembly 40 includes a movable keycap 401, a metal support plate 403 and a switch 429. The movable keycap 401 has a bottom extending to form a hook leg 405. The hook leg 405 has a leg plane embedded with a metal plate 422. The metal support plate 403 includes a cantilever bridge 402 having a bottom which provides a magnet 411 corresponding to the metal plate 422. The switch 429 is located beneath the keycap 401. As the keycap 401 is undepressed, the keycap 401 is in an initial state, the keyswitch assembly 40 is in OFF state and the magnet 411 adheres the metal plate 422. As the keycap 401 moves downward by a force, the magnet 411 escapes from the metal plate 422. As the force is released, the magnetic attraction force between the magnet 411 and the metal plate 422 forces the keycap 401 to resume to its initial state. The label 425 represents a traditional scissors-type supporting element respectively connected to the keycap and the metal support plate. The label 209 represents a conventional membrane disposed on the circuit membrane 407 for protecting the circuit membrane 407. According to a preferred embodiment, the membrane 409 might be a Polyester membrane. As the keycap 401 moves downward by a force, the hook leg 405 actuates the switch 429.

Figure 4B:
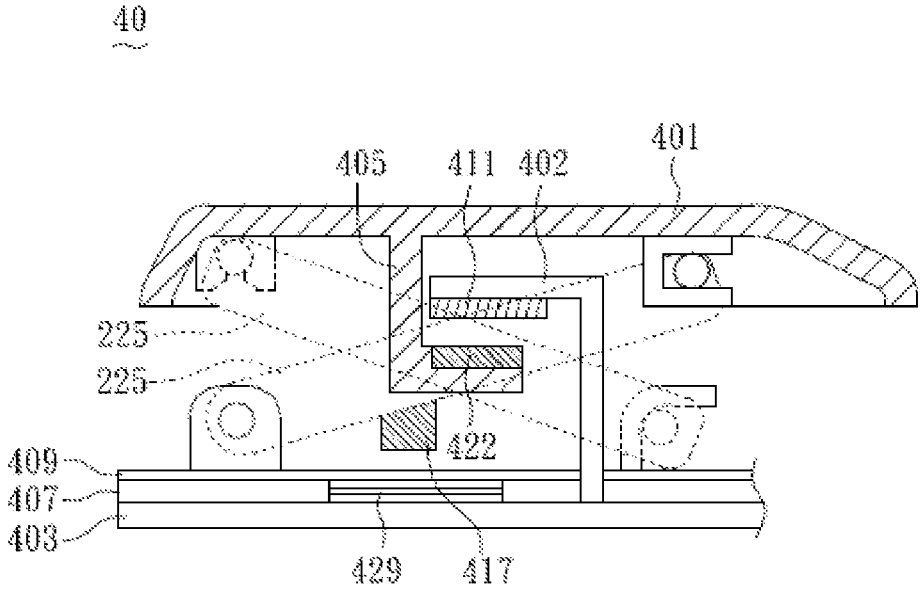
FIG. 4B illustrates still another (seventh) preferred embodiment.

Alternatively, FIG. 4B discloses another preferred embodiment which has parts identical to those shown in FIG. 4A. The difference between this embodiment and that of FIG. 4A resides on that the scissors-type supporting element 425 further has an actuator 417 which actuates the switch 429 as the keycap 401 moves downward by a force.

Figure 4C:
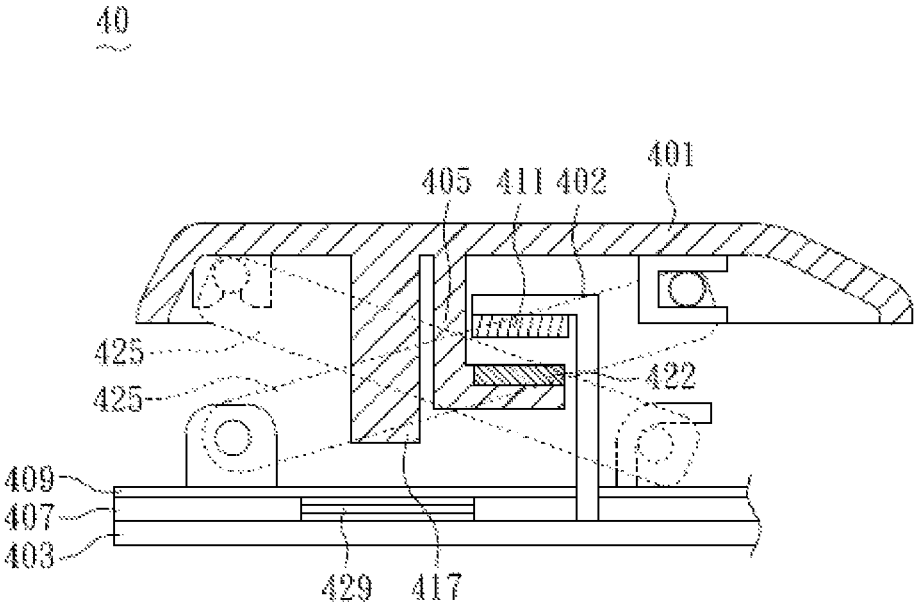
FIG. 4C illustrates still preferred (eighth) embodiment.

FIG. 4C discloses still another preferred embodiment which has parts identical to those shown in FIG. 4A. The difference between this embodiment and that of FIG. 4A resides on that the downside of keycap 401 has an actuator 417 actuating the switch 429 as the keycap 401 moves downward by a force.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A keyswitch assembly comprising:

a movable keycap having a bottom extending to form a hook leg, the hook leg including a leg plane;

a metal support plate and an integral metal cantilever bridge extending upwardly from the metal support plate;

a switch located beneath the keycap;

a magnet disposed over the leg plane;

wherein, as the keycap is undepressed, the keycap is in an initial state and the keyswitch assembly is in OFF state, and the magnet attracts to contact the metal cantilever bridge, as the keycap moves downward by a force, the magnet departs from the metal cantilever bridge, and as the force is released, the magnetic attraction force between the magnet and the metal cantilever bridge makes keycap resumes to the initial state, further comprising a scissors-type supporting element, and the scissors-type supporting element has a first support and second support, and the first support connecting the second support at an intersecting point, the hook leg being positioned at a height same as that of the intersecting point.

2. The keyswitch assembly of claim 1, wherein as the keycap moves downward by a force, the hook leg actuates the switch.

3. The keyswitch assembly of claim 1, further comprising a scissors-type supporting element respectively connected to the keycap and the metal support plate, wherein the scissors-type supporting element has an actuator for actuating the switch as the keycap moves downward by a force.

4. The keyswitch assembly of claim 1, wherein the keycap includes an actuator actuating the switch as the keycap moves downward by a force.

5. A keyboard comprising the keyswitch assembly as recited in claim 1.

6. The keyswitch assembly of claim 1, wherein the hook leg further comprising a lower portion, and the lower portion is beneath the metal cantilever bridge and is located over the switch.

7. The keyswitch assembly of claim 6, wherein as the keycap moves downward by a force, the lower portion actuates the switch.

8. A keyswitch assembly comprising:

a movable keycap having a bottom extending to form a hook leg, the hook leg including a leg plane;

a metal support plate and an integral metal cantilever bridge extending upwardly from the metal support plate;

a switch located beneath the keycap;

a magnet disposed over the leg plane;

wherein, as the keycap is undepressed, the keycap is in an initial state and the keyswitch assembly is in OFF state, and the magnet attracts to contact the metal cantilever bridge, as the keycap moves downward by a force, the magnet departs from the metal cantilever bridge, and as the force is released, the magnetic attraction force between the magnet and the metal cantilever bridge makes keycap resumes to the initial state, further comprising a scissors-type supporting element, and the keycap has two upper connecting portions, the scissors-type supporting element being connected to the keycap at the two upper connecting portions, and the hook leg being positioned between the two upper connecting portions.

9. A keyswitch assembly comprising:

a movable keycap having a bottom extending to form a hook leg, the hook leg including a leg plane;

a metal support plate and an integral metal cantilever bridge extending upwardly from the metal support plate;

a switch located beneath the keycap;

a magnet disposed over the leg plane;

wherein, as the keycap is undepressed, the keycap is in an initial state and the keyswitch assembly is in OFF state, and the magnet attracts to contact the metal cantilever bridge, as the keycap moves downward by a force, the magnet departs from the metal cantilever bridge, and as the force is released, the magnetic attraction force between the magnet and the metal cantilever bridge makes keycap resumes to the initial state, further comprising a scissors-type supporting element, and the metal support plate has two lower connecting portions, the scissors-type supporting element being connected to the metal support plate at the two lower connecting portions, and the integral metal leg being positioned between the two lower connecting portions.

10. The keyswitch assembly of claim 8, wherein as the keycap moves downward by a force, the hook leg actuates the switch.

11. The keyswitch assembly of claim 8, wherein the hook leg further comprising a lower portion, and the lower portion the lower portion is beneath the metal cantilever bridge and is located over the switch.

12. The keyswitch assembly of claim 11, wherein as the keycap moves downward by a force, the lower portion actuates the switch.

13. The keyswitch assembly of claim 9, wherein as the keycap moves downward by a force, the hook leg actuates the switch.

14. The keyswitch assembly of claim 9, wherein the hook leg further comprising a lower portion, and the lower portion the lower portion is beneath the metal cantilever bridge and is located over the switch.

15. The keyswitch assembly of claim 14, wherein as the keycap moves downward by a force, the lower portion actuates the switch.

* * * * *